United States Patent [19]

Uebel

[11] 4,199,264

[45] Apr. 22, 1980

[54] UNBALANCED WEIGHT VIBRATOR

[75] Inventor: Philipp Uebel, Unterschleissheim-Lohhof, Fed. Rep. of Germany

[73] Assignee: Robert Bosch GmbH, Stuttgart, Fed. Rep. of Germany

[21] Appl. No.: 858,530

[22] Filed: Dec. 7, 1977

[30] Foreign Application Priority Data

Feb. 12, 1977 [DE] Fed. Rep. of Germany ..... 2706053

[51] Int. Cl.[2] ..... B01F 11/00

[52] U.S. Cl. ..... 366/123

[58] Field of Search ..... 366/117, 120, 122, 123, 366/127, 128; 74/87; 310/81; 308/194

[56] References Cited

U.S. PATENT DOCUMENTS

| | | | |
|---|---|---|---|
| 2,194,410 | 3/1940 | Svenson | 366/120 |
| 2,876,647 | 3/1959 | Petrin | 366/128 X |
| 3,340,742 | 9/1967 | Chandler | 366/123 X |
| 3,529,190 | 9/1970 | Fontaine | 310/81 |

*Primary Examiner*—Philip R. Coe

*Attorney, Agent, or Firm*—Michael J. Striker

[57] ABSTRACT

A rotating unbalanced weight vibrator is provided. The vibrator comprises a vibrator housing defining and lying on a first axis, and a motor housing having two ends and being normally generally nonconcentrically arranged within the vibrator housing so as to define and lie on a second axis normally inclined relative to the first axis. The motor housing includes a stator extending radially outwardly from the second axis, a drive shaft extending through the stator along the second axis, and a rotor connected to the drive shaft at one of the ends of the motor housing. A universal joint coaxial with one of the axes connects the vibrator housing with the other end of the motor housing so as to preclude rotational movement of the housings relative to each other while permitting orbital movement of the one end of the motor housing about the first axis in response to rotation of the rotor.

3 Claims, 3 Drawing Figures

UNBALANCED WEIGHT VIBRATOR

BACKGROUND OF THE INVENTION

The invention relates to a rotating unbalanced weight vibrator. The vibrator has a vibrator housing lying on and defining an axis, and an electric motor positioned eccentrically in the vibrator housing relative to the axis. The electric motor includes a motor housing receiving a stator, a drive shaft extending lengthwise through the stator and being connected at one end to the vibrator housing with this end turning about the axis of the vibrator housing, and a rotor connected at the opposite end of the drive shaft and turning with the drive shaft.

Conventionally, the ends of the drive shaft are brought across the bearing bracket of the vibrator housing and are fixed in a swing bearing firmly positioned coaxially relative to the axis of the vibrator housing. Ring flanges of elastic material are arranged between the inner surface of the vibrator housing and the outer surface of the motor housing. These flanges brace the motor housing against the vibrator housing, and thereby prevent relative rotational movement between the vibrator housing and the motor housing. An aperture passes through the outer casing of the vibrator housing; an electric cable for supplying electricity to the coils of the stator is passed through this aperture.

This cable supplies the electric motor with alternating or three-phase current having a frequency of 50 Hz or more so that the drive shaft and rotor turn. As it turns, the rotor is also swinging like a pendulum, and this swinging movement is also imparted to the motor housing. The extent of this pendulum movement is determined by the behavior of the drive shaft extending from the vibrator housing. A disadvantage of the conventional embodiments is that the cable swings along with the motor housing; this is disadvantageous because the cable is rigidly connected externally of the vibrator housing to a supply network and the swinging movement alternately pulls and releases the cable in a back and forth movement. This bending movement exerted on the cable and the additional vibrations from the motor which are transmitted to the cable cause the cable to be subjected to a strong mechanical stress which leads to the breaking of the cable after a short time. Another disadvantage of this conventional design is that such a vibrator can only be used as an "outside vibrator" because of the positioning of the cable, and cannot be used as an "inside vibrator," so defined by its capacity to be directly inserted into thickening material.

SUMMARY OF THE INVENTION

An object of the invention is to provide a rotating unbalanced weight vibrator in which the electrical cable is maintained free from substantially all bending and swinging so as to thereby lengthen the working life of the cable.

Another object of the invention is to provide a rotating unbalanced weight vibrator which is capable of being used as an outside vibrator as well as an inside vibrator.

Generally, the motor housing is provided with two opposite ends or sides with the drive shaft passing through one end while the other end is extended away from the drive shaft. In accordance with the inventive concept, this other end of the motor housing is connected to the vibrator housing by way of a universal joint, allowing the motor housing to move freely in all directions relative to the vibrator housing.

This other end of the motor housing may be provided with a hollow nipple extending away from but coaxial relative to the drive shaft. This nipple has two axially spaced ends, one connected to the rest of the motor housing, and the other projecting therefrom to a point remote from the motor housing. This projecting, remote end of the nipple is held by the universal joint.

The inventive concept differs from the conventional art in that the end of the motor housing away from the drive shaft is hinged to the vibrator housing via the universal joint instead of connecting the rotating drive shaft to the vibrator housing. In the embodiments of the inventive concept, a "dead spot" or a rest point is established inside a portion of the nipple within the universal joint. In this dead spot, there is substantially no exertion of bending or swinging forces. By simply connecting the electrical cable with the stator via the inventively produced dead spot, at least substantially all of the bending and swinging stress on the cable can be avoided. Because the cable does not experience any substantial stress transmitted from the motor housing, it is hardly susceptible to the material fatigue found in conventional vibrators.

In accordance with another embodiment of the invention concept, the universal joint may be a swing bearing.

The inventive concept may also be embodied by providing a ball and socket joint, a universal hinge coupling, particularly a gear tooth type clutch, or a rubber ring element as the universal joint.

One variation of the inventive concept involves arranging the swing bearing inside and against the vibrator housing in such a manner that the swing bearing is coaxial with the axis defined by and passing through the vibrator housing. At the end facing away from the drive shaft, the motor housing is provided with a hollow journal or nipple which extends coaxially relative to an axis defined by and passing through the motor housing. This journal or nipple is then received by and connected to the swing bearing.

In a second variation of this inventive concept, the swing bearing can be arranged so that it is within the end of the motor facing away from the drive shaft and it is coaxial with the axis defined by and passing through the motor housing; and the vibrator housing can be provided with a hollow journal or nipple extending inwardly from the back side of the housing and being coaxial relative to the axis defined by and passing through the vibrator housing. This journal or nipple is then received by and connected to the swing bearing. This second embodiment operates in such a manner as to have the same effect as the first variation; orbital movement of the rotor-bearing end of the drive shaft is permitted about the vibrator housing axis in response to rotation of the rotor.

In both of these embodiments, a ball and socket joint for example may be used instead of a swing bearing.

The electrical cable for the stator is passed through the vibrator housing into the motor housing at or at least substantially at the dead spot lying along the axis defined by and passing through the vibrator housing. In the case of the second variation, the electrical cable is passed through an axial bore of the nipple and then through the universal joint and into the electrical motor.

In either variation of location and orientation of the universal joint, a pin projecting radially from the axis defined by and passing through the vibrator housing extends substantially perpendicularly from the remote end of the nipple to the vibrator housing. This pin is useful when a swing bearing or a ball and socket joint is used as a universal joint since the pin secures against relative rotational movement. However, the provision of this pin is superfluous when the universal joint is instead a gear tooth type clutch or a rubber ring element since the teeth of the clutch or the rubber of the ring element absorbs the forces of turning.

In a particularly desirable embodiment of the inventive concept (shown in FIG. 3), the drive shaft is fastened to a stub shaft or an eccentric pin; the stub shaft is then received by a bearing like a roller bearing firmly arranged in the vibrator housing and coaxial to the axis defined by and passing through the vibrator housing. This stub shaft is a short dead axle capable of angular movement about the roller bearing carried by the end of the stub shaft. This type of construction is particularly suitable for vibrators which are operated at very high frequencies and therefore swing at high frequency.

This variation in the construction of the drive shaft may involve providing the drive shaft with a conical bore which increases in diameter in the direction away from the drive shaft. The vibrator housing is then provided with a reciprocally-shaped inwardly directed roller bearing which is coaxial relative to the axis of the vibrator housing and which engages the conical bore. Advantageously, the bore is substantially greater in diameter than the reciprocally shaped roller bearing. Axial displacement of the bearing relative to the bore then results in an increased range of vibration frequency. The imbalancing forces of the vibrator can be easily and rapidly adjusted to the particular circumstances because of the larger range of vibration frequency.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
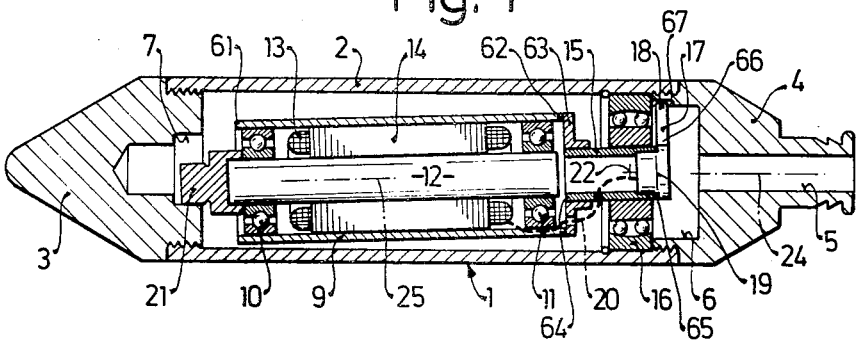
FIG. 1 shows an axial section of the inventive vibrator constructed as an inside vibrator.
Figure 2:
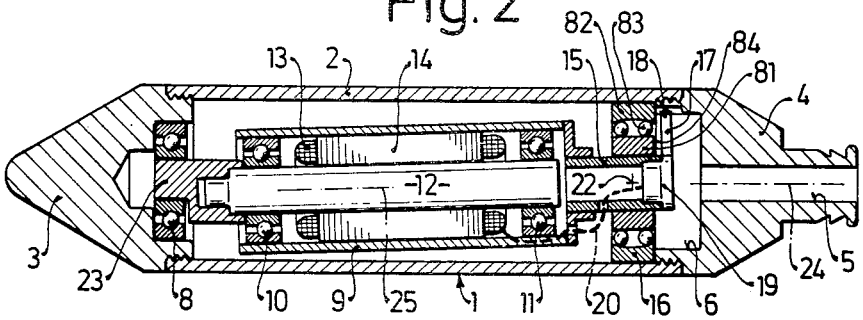
FIG. 2 shows a variation of the construction of FIG. 1.

The rotating unbalanced weight vibrator of FIGS. 1 and 2 has a vibrator housing 1. The vibrator housing 1 includes a cylindrical casing 2, which covers the central portion of housing 1. To the front of the casing 2 is a vibrating tip 3. Behind the casing 2 is an end piece 4 by which the vibrator is suspended when the vibrating tip 3 is projected vertically into material which is to be thickened. The end piece 4 has an axial bore 5 passing therethrough, and has a recess 6 at the side facing the vibrator tip 3 and adjacent and under the casing 2. This recess communicates with the axial bore 5. Inside the vibrator tip 3, a stepped bore 7 is provided which faces towards recess 6 as shown in FIG. 1. This bore 7 can be tapered or frustoconical. FIG. 2 shows this bore 7 after receiving a bearing 8 which is fixed to the vibrator tip 3 and which is oriented coaxially relative to the vibrator housing axis 24.

The electric motor is suspended for pendulating motion inside the vibrator housing 1 and has a cylindrical motor housing 9. Ball bearings 10 and 11 are arranged inside this motor housing 9 coaxially relative to the drive shaft 12. A rotor is fixed to the drive shaft 12 in such a manner as to be free from rotational movement relative to the drive shaft 12. The rotor may be integral with the drive shaft, and may have the same diameter. The rotor spins in an air space as a varying voltage or alternating current network 13 supplies power to the stator 14. The stator 14 is maintained in a rotation-free position inside the motor housing 9.

The motor housing 9 extends lengthwise through the vibrator housing 1 and has two opposite ends, one end 61 facing the vibrator tip 3 and the other end 62 facing the end piece 4. End 62 is covered radially with a ring flange 63 which carries a hollow nipple 15. The nipple 15 is oriented coaxially relative to the motor housing axis 25. This nipple 15 has two axially spaced ends, one end 64 being held by the flange 63. The nipple 15 is held in a swing bearing 16; the other axially spaced end 65 projects beyond the bearing 16 and faces the recess 6. The swing bearing 16 is stationarily fixed directly in front of the recess 6 in an orientation which is coaxial relative to the vibrator housing axis 24. Pin 17 has two radially spaced ends, one 66 of which is connected to end 65 of the nipple 15. The pin 17 extends radially from the nipple 15; the other end 67 of pin 17 is locked in an axially aligned pin 18 connected to end piece 4. Preferably, pin 17 is a part of an insert 19 which is inserted onto the end 65 of the nipple 15. Since the insert 19 connects the end piece 4 and the nipple, rotational movement of the motor housing 9 relative to the end piece 4 and therefore the vibrator housing 1 is prevented. The insert 19 has an axial boring communicating with the interior of the hollow nipple 15 and through which the electric cable is passed.

As illustrated by FIG. 1, a pilot 21 is mounted on the motor shaft 12 and protrudes beyond end 61 of the motor housing 9. The pilot 21 is mounted in such a manner as to be free from rotational movement relative to the drive shaft 12. This pilot 21 engages the enlarged part of the bore 7 inside the vibrator tip 3. The basic circular diameter of the pilot 21 is chosen so that it is smaller than that of the bore 7. The proportion of the pilot diameter to the bore diameter determines the ratio between the rotational speed and the oscillation and therefore determines the oscillating frequency of the vibrator. The tips of the conical surface of the bore 7 and the pilot 21 lie along axes which pass through the center of the swing bearing 16. At least approximately at the point of intersection of these non-parallel axes, there is a dead spot 22 located within the nipple 15 in a portion circumscribed by the swing bearing 16. This dead spot is the single point of rest of the motor housing during its pendulum movement.

The swing bearing 16 includes an inner ring 81, circumscribing nipple 15, an outer ring 82, a plurality of bearing bodies 83 intermediate the rings and locking means 84 preventing rotational movement of either ring relative to the other.

In FIG. 2, an eccentric plug 23 is positioned between a roller bearing 8 which is arranged against the interior of the vibrator tip 3. The plug 23 extends from the bearing 8 to the housing 9. The end of the shaft 12 facing the vibrator tip 3 is rigidly and eccentrically fastened in the plug 23.

In FIGS. 1 and 2 the cable 20 for the stator 14 is positioned in such a manner that it is fastened to the motor housing and extends directly, as close as possible, through the dead spot 22 inside the hollow nipple 15. The cable 20 leaves end 65 of the nipple 15 in an axial direction through bore 5 of the vibrator housing 1.

The motor is connected to the network 14 which supplies an alternating or three-phase current—the drive shaft 12 rotates in a conical pattern about vibrator housing axis 24 on account of the eccentric seating of the shaft 12 inside the plug 24 in the vibrator tip 3. The speed of rotation of the drive shaft 12 can then be shifted to a more or less high frequency oscillation. Since it extends through the only dead spot 22, the cable 20 is minimally affected by these oscillations. Bending of the cable 20 is completely avoided or at least reduced to an unobservable stress.

Figure 3:
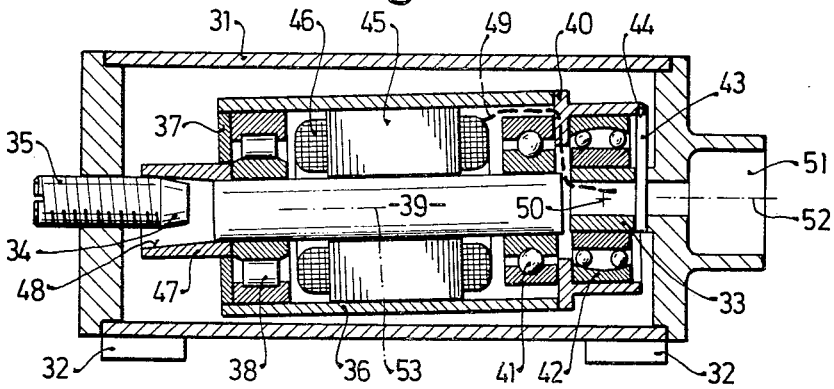
FIG. 3 shows an axial section of the inventive vibrator constructed as an outside vibrator.

The outside vibrator shown in FIG. 3 has a housing 31 which is built chiefly as a supporting frame and is set up for example on a vibrator plate 32. Coaxial pins are arranged on the front and back sides in and against the supporting frame or vibrator housing 31. The pin on the right of the drawing is formed as the hollow nipple 33, and the pin on the left is formed as roller bearing 34 which gradually decreases in diameter in direction towards the shaft 39. The roller bearing 34 can be axially adjusted along the vibrator housing axis 52 in a direction towards or away from the shaft 39 by means of the thread 35. The motor has a cylindrical motor housing 36 which is closed at its front and back sides by bearing brackets. The left bearing bracket 37 holds a ball bearing or roller bearing 38 in a rotation-free position through which the motor shaft 39 is passed. The right bearing bracket 40 carries on its motor-directed side 68 a ball bearing 41 through which the motor shaft 39 is passed. On the other side 69 which faces away from the motor, the bracket 40 carries a swing bearing 42 which is firmly fixed coaxially relative to the motor housing axis 53 and which receives the nipple 33 of the supporting frame 31. In order to secure the motor housing 36 against rotational movement relative to the support frame 31, a radially projecting pin 43 is fastened in a radial extending bore of the nipple 33. This nipple 33 engages a recess 44 in the bracket 40 so as to securely connect the motor housing 36 and the supporting frame 31. Usually, the stator 45 is fixed in the motor housing 36 along with its electrical coils 46. The rotor is carried on the shaft 39 in such a way that it will not rotate relative to the shaft 39. The shaft 39 is mounted in the two bearings 38 and 41 in the motor housing 36, and is connected rotation-free to a hollow stub shaft 47 at the side of the shaft facing the roller bearing 34. This stub shaft 47 is provided with a bore 48 which is gradually reduced in diameter in the direction towards the shaft 39. The roller bearing 34 embraces this bore 48. The smallest diameter of this bore 48 is substantially greater than that of the diameter of the roller bearing 34—about twice as great as shown in FIG. 3. A larger or smaller roller bearing 34 can be substituted to thereby influence the vibrating.

By axial displacement of the roller bearing 34, the bearing 34 can be moved axially back and forth in the bore 48 and consequently the basic pattern of the conical movement of the motor shaft 39 about the vibrator housing axis 52 is changed.

The electric cable 49 for supplying current to the stator coils 46 is connected to the bearing bracket 40 and is lead directly forward from the dead spot 50 in the interior of the hollow nipple 33 and then through the bore 51 in the vibrator housing 31 from which it is lead and connected to a source of power.

The function and operation of this outside vibrator illustrated by FIG. 3 is the same as that previously described for the inside vibrator. By leading the cable 44 through the dead spot 50, the cable is spared from all noteworthy vibratory motion.

It will be understood that each of the elements described above, or two or more together, may also find a useful application in other types of rotating of unbalanced weight vibrator differing from the types described above.

While the invention has been illustrated and described as embodied in constructions, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A rotating unbalanced weight vibrator comprising a vibrator housing defining and lying on a first axis; a motor housing having two ends and being normally generally nonconcentrically arranged within the vibrator housing so as to define and lie on a second axis normally inclined relative to the first axis, the motor housing including a stator extending radially outwardly from the second axis, a drive shaft extending through the stator along the second axis, a rotor connected to the drive shaft at one of the ends of the motor housing, and a nipple coaxial with said second axis and which is connected to and circumscribed by a swivel joint coaxial with one of the axes, connecting the vibrator housing with the other end of said motor housing and precluding rotational movement of said housings relative to each other while permitting orbital movement of said one end of said motor housing about said first axis in response to rotation of said rotor, thereby providing a dead spot in which forces of bending and vibration are absent within a circumscribed portion of said nipple; and an electrical cable passed through the vibrator housing substantially through the dead spot and being connected to the stator.

2. A rotating unbalanced weight vibrator comprising a vibrator housing defining and lying on a first axis, said vibrator housing including a vibrating tip extending radially outwardly of said first axis and having a hollow interior portion, and a bearing located in the interior portion and including an inner ring extending radially about said first axis, an outer ring extending around said inner ring and being located against the vibrating tip, and a bearing body intermediate to said inner and outer rings; a motor housing having two ends and being normally generally nonconcentrically arranged within the vibrator housing so as to define and lie on a second axis normally inclined relative to the first axis, the motor housing including a stator extending radially outwardly from the second axis, a drive shaft extending through the stator along the second axis, a rotor connected to the drive shaft at one of the ends of the motor housing, and a plug extending axially from said drive shaft and including an annular portion which extends into and is circumscribed by said bearing, said annular portion being eccentrically positioned within the vibrator housing; and a swivel joint coaxial with one of the axes, connecting the vibrator housing with the other end of said motor housing and precluding rotational movement of said housings relative to each other while permitting orbital movement of said one end of said motor housing about said first axis in response to rotation of said rotor.

3. A rotating unbalanced weight vibrator comprising a vibrator housing defining and lying on a first axis; a motor housing having two ends, one end including an outwardly projecting nipple, and being normally generally nonconcentrically arranged within the vibrator housing so as to define and lie on a second axis normally inclined relative to the first axis, with which second axis said nipple is coaxial, said motor housing including a stator extending radially outwardly from the second axis, a drive shaft extending through the stator along the second axis, and a rotor connected to the drive shaft at one of the ends of the motor housing; a swivel joint coaxial with one of the axes, connecting the vibrator housing with the other end of said motor housing and precluding rotational movement of said housings relative to each other while permitting orbital movement of said one end of said motor housing about said first axis in response to rotation of said rotor; and a pin projecting radially from said second axis and connecting said nipple to said vibrator housing.

* * * * *